United States Patent [19]

Sone et al.

[11] 4,359,030

[45] Nov. 16, 1982

[54] SYSTEM FOR FEEDBACK CONTROL OF AIR/FUEL RATIO IN IC ENGINE WITH MEANS TO CONTROL SUPPLY OF CURRENT TO OXYGEN SENSOR

[75] Inventors: Kohki Sone, Tokyo; Kenji Okamura, Zushi, both of Japan

[73] Assignee: Nissan Motor Company, Limited, Yokohama, Japan

[21] Appl. No.: 199,630

[22] Filed: Oct. 22, 1980

[30] Foreign Application Priority Data

Oct. 25, 1979 [JP] Japan ..... 54-148150[U]

[51] Int. Cl.[3] ..... F02M 7/00

[52] U.S. Cl. ..... 123/440; 204/195 S

[58] Field of Search ..... 123/440, 489; 60/276, 60/285; 204/195 S, 1 S; 73/23

[56] References Cited

U.S. PATENT DOCUMENTS

| | | | |
|---|---|---|---|
| 3,915,135 | 10/1975 | Kushida et al. | 60/276 |
| 4,107,019 | 8/1978 | Takao et al. | 204/195 S |
| 4,112,893 | 9/1978 | Anzai | 123/440 |
| 4,140,085 | 2/1979 | Rabus et al. | 60/276 |
| 4,207,159 | 6/1980 | Kimura et al. | 204/195 S |

FOREIGN PATENT DOCUMENTS

| | | | |
|---|---|---|---|
| 54-109523 | 8/1979 | Japan | 123/440 |

*Primary Examiner*—P. S. Lall

*Attorney, Agent, or Firm*—Schwartz, Jeffery, Schwaab, Mack, Blumenthal & Koch

[57] ABSTRACT

A system for feedback control of air/fuel ratio in an IC engine, utilizing an oxygen-sensitive device which is provided with a heater and disposed in exhaust gas to provide a feedback signal. This device has a porous solid electrolyte layer with an outer electrode layer on one side and an inner electrode on the other side facing a substrate. There is a circuit to supply a heating current to the heater and also force a DC current to flow in the solid electrolyte layer to cause migration of oxygen ions therethrough toward the inner electrode to thereby establish a reference oxygen partial pressure on the inner side of the solid electrolyte layer. This circuit is provided with current intensity regulation means to temporarily decrease the intensity of the current flowing in the solid electrolyte layer by a predetermined value while the oxygen-sensitive device is not sufficiently heated to thereby preclude undesirable rise of the basic level of the output voltage of the oxygen-sensitive device by the effect of an increased internal resistance of the not sufficiently heated element.

5 Claims, 6 Drawing Figures

SYSTEM FOR FEEDBACK CONTROL OF AIR/FUEL RATIO IN IC ENGINE WITH MEANS TO CONTROL SUPPLY OF CURRENT TO OXYGEN SENSOR

BACKGROUND OF THE INVENTION

This invention relates to a system for feedback control of the air/fuel ratio in an internal combustion engine. The system includes an air/fuel ratio detector having an oxygen-sensitive element of the oxygen concentration cell type operated with a DC current to establish a reference oxygen partial pressure in the element and provided with an electric heater to ensure proper functioning of this element. More particularly, the present invention relates to a sub-system for controlling the intensity of the aforementioned current in dependence upon the temperature of the oxygen-sensitive element with a view to keeping the element active even when not sufficiently heated.

It has become popular to control the air/fuel mixture ratio supplied to internal combustion engines to precisely a predetermined optimal value by performing feedback control with the dual objects of improving the efficiency of the engine and reducing the emission of noxious or harmful substances contained in exhaust gases.

For example, in an automotive engine system including a catalytic converter in the exhaust passage, which contains a so-called three-way catalyst that can catalyze both the reduction of nitrogen oxides and oxidation of carbon monoxide and unburned hydrocarbons, it is desirable to control the air/fuel mixture ratio to a stoichiometric ratio because this catalyst exhibits its highest conversion efficiencies in an exhaust gas produced by combustion of a stoichiometric air-fuel mixture, and also because the employment of a stoichiometric mixing ratio is favorable for high mechanical and thermal efficiencies. It is already known to perform feedback control of the air/fuel ratio in an engine system by using a sort of oxygen sensor, installed in the exhaust passage upstream of the catalytic converter, as a device for providing an electrical feedback signal indicative of the air/fuel ratio of an air-fuel mixture actually supplied to the engine. Based on this feedback signal, a control circuit commands a fuel-supplying apparatus, such as electronically controlled fuel injection valves, to control the rate of fuel feed to the engine so as to nullify or minimize deviations of actual air/fuel ratio from the intended stoichiometric ratio.

Usually the above mentioned oxygen sensor is of an oxygen concentration cell type utilizing an oxygen ion conductive solid electrolyte, such as zirconia stabilized with calcia, and conventionally the sensor is constituted of a solid electrolyte layer in the shape of a tube closed at one end, a measurement electrode layer porously formed on the outer side of the solid electrolyte tube and a reference electrode layer formed on the inner side of the tube. When there is a difference in oxygen partial pressure between the reference electrode side and measurement electrode side of the solid electrolyte tube, this sensor generates an electromotive force between the two electrode layers. As an air/fuel ratio detector for the above mentioned purpose, the measurement electrode is exposed to an engine exhaust gas while the reference electrode on the inside is exposed to atmospheric air utilized as the source of a reference oxygen partial pressure. In this state the magnitude of the electromotive force generated by this sensor exhibits a great and sharp change between a maximally high level and a very low level each time when the air/fuel ratio of a mixture supplied to the engine changes across the stoichiometric ratio. Accordingly it is possible to produce a fuel feed rate control signal based on the result of a comparison of the output of the oxygen sensor with a reference voltage which has been set at the middle of the high and low levels of the sensor output.

However, this type of oxygen sensor has disadvantages such as the significant temperature dependence of its output characteristics, the necessity of using a reference gas such as air, the difficulty in reducing its size and the insufficiency of mechanical strength.

To eliminate such disadvantages of the conventional oxygen sensor, U.S. Pat. No. 4,207,159 discloses an advanced device comprising an oxygen-sensitive element in which an oxygen concentration cell is constituted of a flat and microscopically porous layer of solid electrolyte, a measurement electrode layer porously formed on one side of the solid electrolyte layer and a reference electrode layer formed on the other side on a base plate or substrate such that the reference electrode layer is sandwiched between the substrate and the solid electrolyte layer and macroscopically shielded from the environmental atmosphere. Each of the three layers on the substrate can be formed as a thin, film-like layer. This device does not use any reference gas. Instead, a DC power supply means is connected to the oxygen-sensitive element so as to force a constant DC current (e.g. of a current intensity of about 20 $\mu$A) to flow through the solid electrolyte layer between the two electrode layers to thereby cause migration of oxygen ions through the solid electrolyte layer in a selected direction and, as a consequence, establish a reference oxygen partial pressure at the interface between the solid electrolyte layer and the reference electrode layer, while the measurement electrode layer is made to contact an engine exhaust gas. Where the current is forced to flow through the solid electrolyte layer from the reference electrode layer toward the measurement electrode layer, there occur ionization of oxygen contained in the exhaust gas at the measurement electrode and migration of negatively charged oxygen ions through the solid electrolyte layer toward the reference electrode. The rate of supply of oxygen in the form of ions to the reference electrode is primarily determined by the intensity of the current. The oxygen ions arriving at the reference electrode layer are deprived of electrons and turn into oxygen molecules which results in an accumulation of gaseous oxygen on the reference electrode side of the concentration cell. However, a portion of the accumulated oxygen molecules diffuse outwardly through the microscopical gas passages in the solid electrolyte layer. Therefore, it is possible to maintain a constant and relatively high oxygen partial pressure which can serve as a reference oxygen partial pressure at the interface between the reference electrode layer and the solid electrolyte layer by the employment of an appropriate current intensity with due consideration for the microscopical structure and activity of the solid electrolyte layer. Between the reference and measurement electrode layers of this oxygen-sensitive element is generated an electromotive force, the magnitude of which is related to the composition of the exhaust gas and the air/fuel ratio of a mixture from which the exhaust gas is produced. In addition it is possible to operate this oxygen-sensitive element by forcing a current to flow therein from the measurement electrode layer toward the reference electrode layer. In this case a constant and relatively low oxygen partial pressure can be maintained at the interface between the reference electrode layer and the solid electrolyte layer.

To supply a DC current of an accurately constant intensity, use is made of a constant current supply circuit including conventional electronic control means.

The device according to U.S. Pat. No. 4,207,159 has advantages over concentration cell oxygen sensor elements in that it does not require the use of any reference gas, it can be produced in a relatively small size and exhibits good resistance to mechanical shocks and vibrations.

In practical applications it becomes necessary to provide this device (also conventional oxygen sensors of the solid electrolyte concentration cell type) with an electric heater because the activity of the solid electrolyte layer in the device becomes unsatisfactorily low when the temperature of the oxygen-sensitive element is relatively low, e.g. is below about 400° C., so that the oxygen-sensitive element installed in an engine exhaust system becomes ineffective as an air/fuel ratio detector when the engine discharges a relatively low temperature exhaust gas and if the element should be heated solely by the heat of the exhaust gas. Therefore, an electric heater is usually attached to, or embedded in, the sustrate of the oxygen-sensitive element.

During the operation of this oxygen-sensitive device with the maintenance of a constant DC current flowing through the solid electrolyte layer (which has a considerable electrical resistance) an output voltage can be measured between the reference and measurement electrode layers. This voltage represents the sum of an electromotive force generated by the function of the oxygen-sensitive element as an oxygen concentration cell and a voltage developed across the reistant solid electrolyte layer by the flow of the constant current therethrough. The resistance of the solid electrolyte layer depends significantly on the temperature of this layer or the oxygen-sensitive element and greatly increases as the temperature lowers.

In an air/fuel ratio control system utilizing this oxygen-sensitive device as an air/fuel ratio detector, the value of a reference voltage, with which the output voltage of the detector is compared as an initial step in the process of producing an air/fuel ratio control signal, is determined on the assumption that the detector is sufficiently heated by the heat of the exhaust gas and by the action of the heater so that the internal resistance of the detector (principally the resistance of the solid electrolyte layer) is at a fairly low level. Usually this reference voltage is so determined as to correspond to an intended air/fuel ratio such as a stoichiometric air/fuel ratio. Where the aforementioned assumption is accurate, a basic or so-called DC level of the output voltage of the detector, excluding a variable component attributable to the electromotive force whose magnitude depends upon the composition of the exhaust gas, is not greatly different from the reference voltage. When the feedback control of air/fuel ratio is performed under such conditions actual air/fuel ratio exhibits periodic fluctuations of a certain amplitude with the target value of the control as the middle line. Therefore, the output voltage of the detector also exhibits periodic fluctuations across the reference voltage at a relatively low frequency such as several hertz. Accordingly, it is possible to continue the feedback control by appropriately altering the meaning of the air/fuel ratio control signal based upon the high-low relationship between the detector output voltage and the reference voltage so as to minmize the amplitude of the fluctuations of the actual air/fuel ratio.

When, however, the air/fuel ratio detector is operated while its oxygen-sensitive part is not sufficiently heated and hence is very high in its internal resistance, the DC level of the output voltage becomes very high and far above the determined reference voltage so that the output voltage remains above the reference voltage irrespective of the magnitude of electromotive force the element generates. Under this condition, therefore, it is impossible to perform feedback control of air/fuel ratio by utilizing the output of the detector as a feedback signal.

In practice, this situation is encountered at cold-starting of the engine. The heater in the detector is energized synchronously with ignition of the engine, and the oxygen-sensitive part of the detector is soon exposed to exhaust gas. However, the heating effects of the two heat sources are not instantaneous. The temperature of the oxygen-sensitive part rises gradually as the heater is kept working and the exhaust gas temperature rises gradually, so that the internal resistance of the oxygen-sensitive element and hence the DC level of the output voltage lowers gradually. It will be a few minutes, a relatively long period of time from the viewpoint of an electronic control technique, before the DC level of the output voltage becomes low enough to allow the output voltage to serve as a feedback signal, which becomes either higher or lower than the reference voltage depending on the direction of a deviation of the actual air/fuel ratio from the predetermined optimum air/fuel ratio, whereby feedback control of air/fuel ratio becomes practicable. For this reason, it is usual to suspend the feedback control of air/fuel ratio and to perform an open-loop control to feed the engine with a somewhat fuel-enriched mixture during the aforementioned time period. However, this is detrimental in terms of purification of the exhaust gas and improvement of fuel economy. A similar situation is encountered during idling of the engine.

SUMMARY OF THE INVENTION

It is an object of the present invention to provide a system for feedback control of air/fuel ratio in an internal combustion engine, which system utilizes an oxygen-sensitive air/fuel ratio detector of the type disclosed in U.S. Pat. No. 4,207,159 provided with an electric heater and disposed in an exhaust passage and which has the ability to perform the intended feedback control even when the oxygen-sensitive part of the detector is relatively low in temperature and considerably high in internal resistance, thereby enabling the system to immediately commence feedback control even at cold-starting of the engine.

A feedback control system according to the invention comprises an electrically controllable fuel supplying means provided in the intake system of an internal combustion engine; an air/fuel ratio detector disposed in the exhaust passage of the engine having an oxygen-sensitive element of a concentration cell type comprising a substrate, a microscopically porous reference electrode layer formed on the substrate, a microscopically porous layer of an oxygen ion conductive solid electrolyte formed on the substrate so as to cover the reference electrode layer substantially entirely and a microscopically porous measurement electrode layer formed on the solid electrolyte layer and an electric heater; and a fuel feed control means for providing a control signal to the fuel supplying means to control the rate of fuel feed to the engine so as to maintain a predetermined air/fuel ratio by utilizing an output voltage of the air/fuel ratio detector as a feedback signal. This control system further comprises a sub-system to supply a heating current to the heater of the air/fuel ratio detector and force a DC current of a predetermined intensity to flow through the solid electrolyte layer of the oxygen-sensitive element from the reference electrode layer toward the measurement electrode layer to cause migration of oxygen ions through the solid electrolyte layer from the measurement electrode layer toward the reference electrode layer to thereby establish a reference oxygen partial pressure at the interface between the reference electrode layer and the solid electrolyte layer. This sub-system further comprises temperature detection means for detecting the temperature of the oxygen-sensitive element as an indication of the internal resistance between the reference and measurement electrode layers of the element and for providing a command signal while the detected temperature is below a predetermined temperature, and current regulation means for decreasing the intensity of the DC current flowing through the solid electrolyte layer from the aforementioned predetermined intensity by a predetermined value while the temperature detection means provides the command signal. Accordingly the basic level of the output voltage of the oxygen-sensitive element can be precluded from undesirably rising while the internal resistance of this element is excessively high.

Preferably, the aforementioned sub-system comprises an additional resistance connected in series with the resistance or resistances needed to produce a DC current of the aforementioned predetermined intensity and an electrically controllable switch which is connected in parallel with the additional resistance and which is normally in the on-state to short-circuit the additional resistance but which switches to the off-state in response to the aforementioned command signal, so that the additional resistance becomes effective to decrease the current intensity while the oxygen-sensitive element is not sufficiently heated.

It is convenient and preferable to detect the temperature of the oxygen-sensitive element by utilizing temperature dependence of the resistance of the electric heater.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
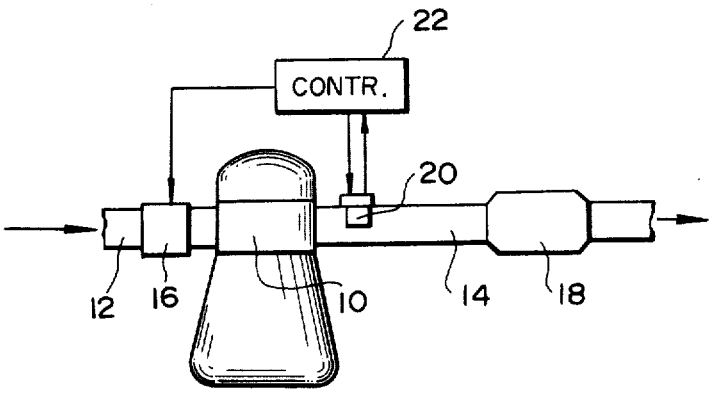
FIG. 1 is a diagrammatic presentation of an internal combustion engine system including an air/fuel ratio control system with which the present invention is concerned.

In FIG. 1, reference numeral 10 indicates an internal combustion engine, which may be an automotive engine, provided with an induction passage 12 and an exhaust passage 14. Indicated at 16 is an electrically or electronically controlled fuel-supplying apparatus such as electronically controlled fuel injection valves. A catalytic converter 18 occupies a section of the exhaust passage 14 and contains therein a conventional three-way catalyst.

To perform feedback control of the fuel-supplying apparatus 16, with the aim of constantly supplying a stoichiometric air-fuel mixture to the engine 10 during its normal operation to thereby allowing the three-way catalyst in the converter 18 to exhibit its best conversion efficiencies, an air/fuel ratio detector 20 (which is an oxygen sensor in principle) is disposed in the exhaust passage 14 at a section upstream of the catalytic converter 18. An electronic control unit 22 receives the output of the air/fuel ratio sensor 20 and provides a control signal to the fuel-supplying apparatus 16 based upon the magnitude of a deviation of the actual air/fuel ratio indicated by the output of the sensor 20 from the stoichiometric air/fuel ratio. As will be illustrated hereinafter by FIG. 2, the air/fuel ratio detector 20 comprises an oxygen-sensitive element of the type requiring the supply of a DC current thereto in order to establish a reference oxygen partial pressure therein, and an electric heater provided in this element. The control unit 22 includes a circuit for supplying a heating current to the heater in the air/fuel ratio detector 20 and a constant DC current to the oxygen-sensitive part of this detector 20.

According to the present invention, this current-supplying circuit is constructed so as to detect the temperature of the oxygen-sensitive part of the air/fuel ratio detector 20 to provide an indication of its internal resistance and to cause a decrease of a predetermined value in the intensity of the DC current flowing in the detector 20 for establishing a reference oxygen partial pressure therein while the detected temperature is below a predetermined temperature. When the aforementioned internal resistance is undesirably great. These functions of the current-supplying circuit according to the invention and the effect thereof will later be described more in detail.

Figure 2:
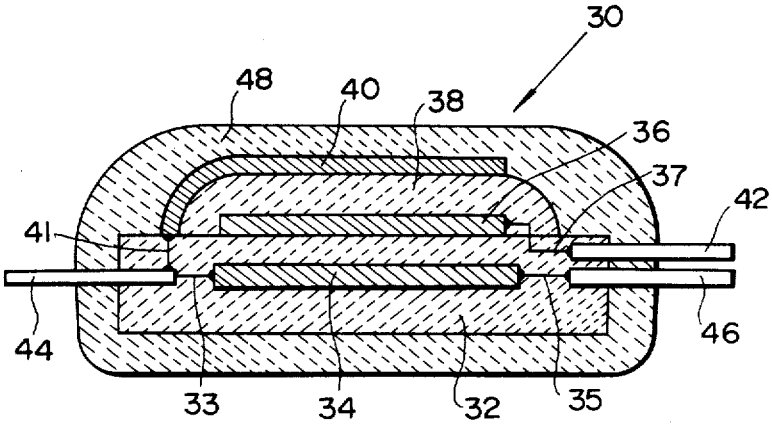
FIG. 2 is a schematic and sectional view of an oxygen-sensitive element of an air/fuel ratio detector employed in the present invention.

FIG. 2 shows an exemplary construction of an oxygen-sensitive element 30 of the oxygen sensor employed as the air/fuel ratio detector 20 in the system of FIG. 1. This element 30 is of the type disclosed in the aforementioned U.S. Pat. No. 4,207,159.

A structurally basic member of this oxygen-sensitive element 30 is a substrate 32 made of a ceramic material such as alumina. A heater element 34 is embedded in the alumina substrate 32 because the oxygen-sensitive element 30 exhibits its proper function only when maintained at sufficiently elevated temperatures, e.g. at temperatures above about 400° C. In practice, the alumina substrate 32 is obtained by face-to-face bonding of two alumina sheets, one of which is provided with the heater element 34 in the form of, for example, a platinum layer of a suitable pattern.

An electrode layer 36 is formed on one side of the substrate 32, and, on the same side, a layer 38 of an oxygen ion conductive solid electrolyte such as $ZrO_2$ stabilized with CaO or $Y_2O_3$ is formed so as to cover substantially the entire area of the electrode layer 36. Another electrode layer 40 is formed on the outer surface of the solid electrolyte layer 38. Platinum is a typical example of electronically conducting materials for the inner and outer electrode layers 36 and 40.

Each of these three layers 36, 38, 40 is a thin, film-like layer (though a "thick layer" in the sense of the current electronic technology), so that the total thickness of these three layers is only about 20 μm by way of example. Macroscopically the inner electrode layer 36 is completely shielded from an environmental atmosphere by the substrate 32 and the solid electrolyte layer 38. However, both the solid electrolyte layer 38 and the outer electrode layer 40 (the inner electrode layer 36 too) are microscopically porous and permeable to gas molecules. As is known, these three layers 36, 38, 40 constitute an oxygen concentration cell which generates an electromotive force when there is a difference in oxygen partial pressure between the inner electrode side and the outer electrode side of the solid electrolyte layer 38. This element 30 is so designed as to establish a reference oxygen partial pressure at the interface between the inner electrode layer 36 and the solid electrolyte layer 38 by externally supplying a DC current to the concentration cell so as to flow through the solid electrode layer 38 between the two electrode layers 36 and 40, while the outer electrode layer 40 is exposed to a gas subject to measurement such as an exhaust gas flowing through the exhaust passage 14 in FIG. 1. Accordingly the inner electrode 36 will be referred to as reference electrode layer and the outer electrode layer 40 as measurement electrode layer.

Attached to the substrate 32 are three lead terminals 42, 44 and 46. The reference electrode layer 36 is electrically connected to the lead terminal 42 either directly or via a lead 37, and the measurement electrode layer 40 is electrically connected to the lead terminal 44 either directly or via a lead 41. The heater element 34 is connected to the lead terminals 44 and 46 either directly or via leads 33, 35, so that the lead terminal 44 serves as a ground terminal common to the heater 34 and the oxygen concentration cell of the element 30. The aforementioned DC current is supplied to the oxygen concentration cell so as to flow from the lead terminal 42 to the ground lead terminal 44 through the solid electrolyte layer 38, and an electromotive force generated by the oxygen concentration cell is measured between these two lead terminals 42 and 44.

As a practical device, the oxygen-sensitive element 30 is substantially entirely covered with a gas permeably porous protective layer 48 of a ceramic material, such as alumina, spinel or calcium zirconate.

The principle of the function of this oxygen-sensitive element 30 has already been described in this specification.

Figure 3:
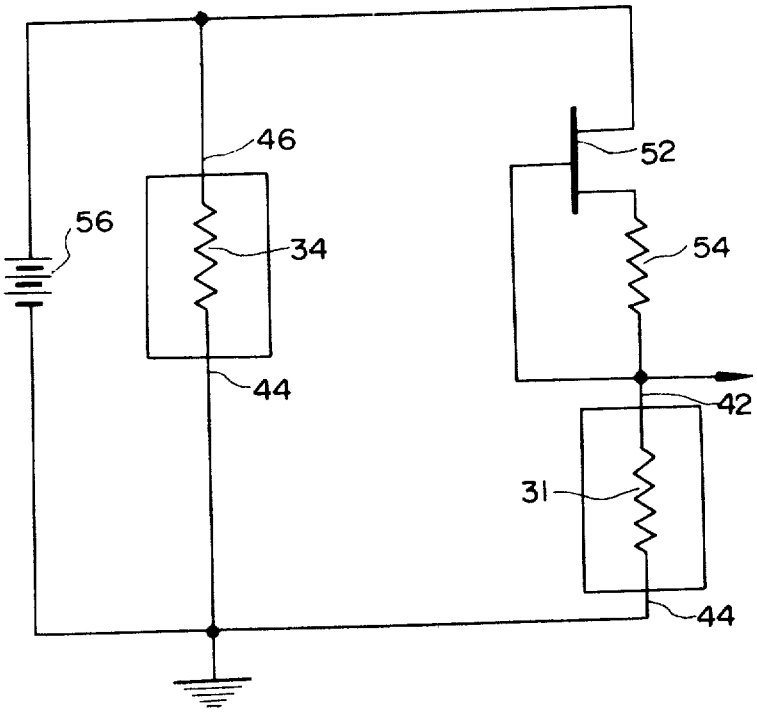
FIG. 3 is a circuit diagram showing a conventional circuit to supply a constant current to the sensitive part of the oxygen-sensitive element of FIG. 2 and a heating current to a heater provided to the same element.

FIG. 3 shows a current-supplying circuit hitherto used as a part of a control unit corresponding to the unit 22 in FIG. 1 to supply a heating current to the heater 34 in the oxygen-sensitive element 30 of FIG. 2 and a constant DC current to the oxygen concentration cell (in FIG. 3 represented by a resistance 31) of the same element 30.

The heating current is supplied to the heater 34 directly from a DC power source 56 such as a battery through usual resistors and a main switch (omitted from illustration).

A constant-current producing part of this current-supplying circuit is constituted of an field-effect transistor 52 and a resistor 54 in a well known manner. The source of the FET 52 is connected to the positive terminal of the power source 56, and the drain is connected to the lead terminal 42 of the oxygen-sensitive element 30 through the resistor 54, so that a constant DC current is forced to flow through the oxygen concentration cell 31 from the reference electrode layer 36 toward the measurement electrode layer 40 even if certain changes occur in the internal resistance of the cell 31. Of course, the intensity of the current supplied from this circuit to the cell 31 does not vary even though the oxygen concentration in the exhaust gas varies considerably.

Therefore, the DC level of an output voltage measured between the two leads 42 and 44 of the cell 31 depends on the internal resistance of this cell 31 and hence on the temperature of this cell 31, as described hereinbefore.

Figure 4:
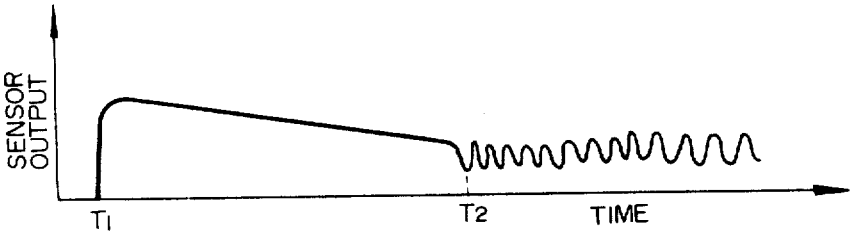
FIG. 4 is a chart illustrating the function of the oxygen-sensitive element of FIG. 2, which is employed in the engine system of FIG. 1 and operated by the circuit of FIG. 3, during a starting phase of the engine operation.

FIG. 4 explanatorily illustrates gradual lowering of the DC level of the output voltage of the sensor 20 incorporated in the system of FIG. 1 and operated by the circuit of FIG. 3 during a cold-starting phase of the engine operation. The engine 10 is started at time point $T_1$, whereupon current is supplied to the heater 34 and to the cell 31. By the effect of the operating current, this cell 31, i.e. sensor 20, soon begins to produce an output voltage. Initially this output voltage has a very high DC level because of the very high value of the internal resistance of the cell 31 which has not yet been heated sufficiently. As the heater 34 is kept working and the exhaust gas temperature gradually rises, the internal resistance of the cell 31 lowers gradually and accordingly the DC level of the sensor output voltage lowers gradually. For a time period of about two minutes, however, the DC level of the output voltage remains distinctly above a reference voltage, which has been preset in the control unit 22 to examine an air/fuel ratio implied by the output of the sensor 20, i.e., to determine whether the air/fuel ratio of the mixture actually supplied to the engine 10 is above or below the predetermined air/fuel ratio. Therefore, during this time period the control unit 22 cannot perform the function of producing a proper control signal based upon a comparison of the sensor output voltage with a reference voltage. At time point $T_2$, at length the DC level of the output voltage reaches the level of the reference voltage, and from the moment onward the output voltage continues to periodically fluctuate across the reference voltage in response to fluctuations of the air/fuel ratio realized in the engine 10; i.e., the output voltage becomes higher than the reference voltage when the air/fuel ratio is below the intended stoichiometric ratio and lower than the reference voltage when the air/fuel ratio is above the stoichiometric. Accordingly it only becomes possible to commence the intended feedback control of the air/fuel ratio at the time point $T_2$, that is, after a lapse of about two minutes from the starting of the engine, and continue the feedback control thereafter (except under specific operating conditions where the exhaust gas temperature becomes very low).

The output voltage may exhibit periodic fluctuations even during the time period between the time points $T_1$ and $T_2$ if changes occur in actual air/fuel ratio, but such fluctuations are omitted from the illustration in FIG. 4 since they would be ineffective for the practice of the feedback control.

Figure 5:
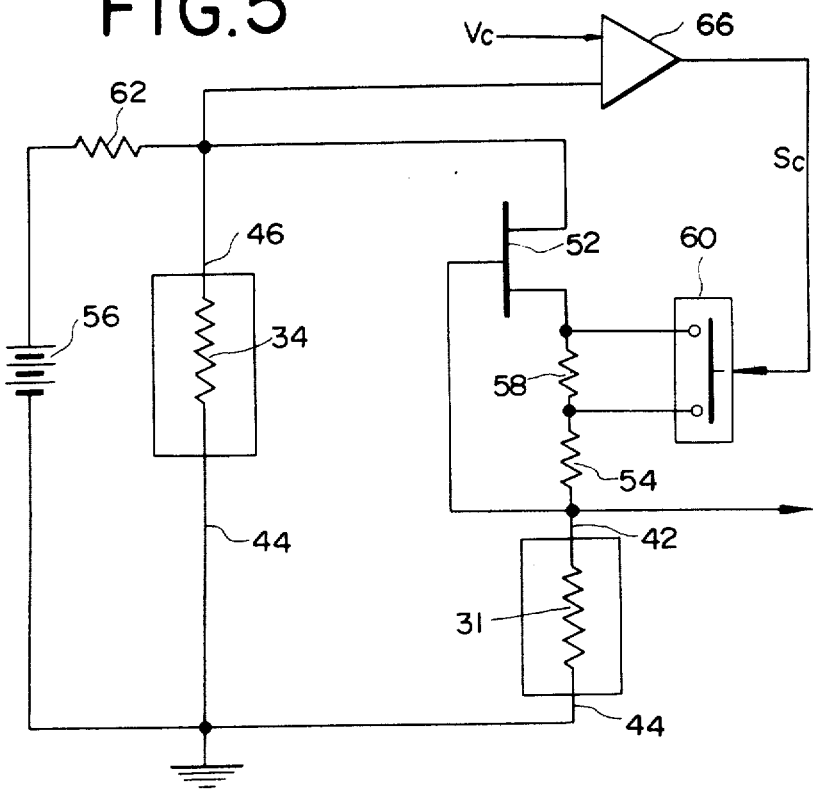
FIG. 5 is a circuit diagram showing a current-supplying circuit for the oxygen-sensitive element of FIG. 2 in the engine system of FIG. 1, as an embodiment of the present invention.

FIG. 5 shows an example of a current supplying system according to the invention. As can be seen, this circuit is a modification of the circuit of FIG. 3. As a fundamental point of the modification, an additional resistance 58 is inserted between the field-effect transistor 52 and the resistance 54, and a normally-closed and electrically controllable switch 60 is connected in parallel with the added resistance 58. This switch 60 may be either an electromagnetic relay or a semiconductor switch such as a switching transistor. In addition, a fixed resistance 62 is inserted between the power source 56 and the heater 34, and the circuit is provided with a comparator 66 with its one input terminal connected to a junction between the resistance 62 and the heater 34 and the other input terminal to a source of a predetermined constant voltage $V_c$.

The purpose of the comparator 66 is to indirectly detect the level of the internal resistance of the cell 31 of the oxygen-sensitive element 30 from the temperature of the same element 30 and, when the detected internal resistance is too high, produce a command signal $S_c$ which causes the switch 60 to take the open-state. As the most simple and convenient method of detecting the temperature of oxygen-sensitive element 30, the heating-current supplying part of the circuit is connected to the comparator 66 (in the illustrated manner in view of the fact that the resistance of the heater 34 is an indication of the temperature to be detected). The magnitude of the constant voltage $V_c$ is determined to correspond to a temperature at which the internal resistance of the cell 31 is low enough to lower the DC level of the output voltage of the cell 31 to the level indicated at the time point $T_2$ in FIG. 4.

While the detected temperature is above the predetermined temperature implied by the constant voltage $V_c$, the comparator 66 does not provide command signal $S_c$, so that the switch 60 remains closed to short-circuit the resistance 58. In this state, the constant-current supplying part of the circuit of FIG. 5 is functionally identical with the counterpart in FIG. 3. When the detected temperature is below the predetermined temperature, the comparator 66 provides the command signal $S_c$ to the switch 60, and then the switch 60 take an open position or off-state with the result that the resistance 58, in addition to the resistance 54, is effective to determining the intensity of the current being supplied to the cell 31. As a natural consequence, the intensity of the current decreases by a definite value determined by the value of the added resistance 58. For example, the values of the respective resistances 54 and 58 are made such that the intensity of the constant current is about 20 microamperes while the resistance 58 is short-circuited but decreases to a few microamperes while the resistance 58 is made effective by the opened switch 60.

Figure 6:
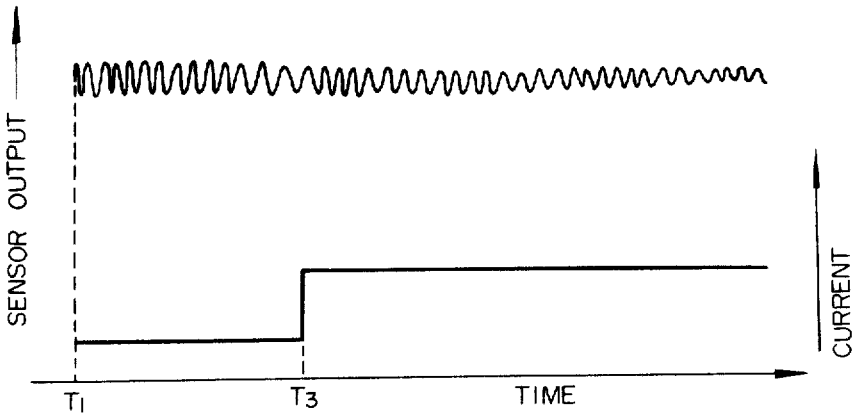
FIG. 6 is a chart illustrating the function of the oxygen-sensitive element of FIG. 2, which is employed in the engine system of FIG. 1 and operated by the current-supplying circuit of FIG. 5, as well as the function of the circuit of FIG. 5, during a starting phase of the engine operation.

FIG. 6 explanatorily illustrates the effect of the above described new function of the circuit of FIG. 5 on the output level of the sensor 20 in the system of FIG. 1 during a cold-starting phase of the engine operation. The engine 10 is started at time point $T_1$, simultaneously commencing the supply of the heating current to the heater 34 and operating current to the cell 31. Since the resistance of the heater 34 indicates that the temperature of the cell 31 is below the predetermined temperature implied by the constant voltage $V_c$, the switch 60 is in the open or off-state, whereby the cell 31 is supplied with a constant current of a very small intensity. Hence, the DC level of the output voltage of the sensor 20 becomes fairly low and comparable to the reference voltage preset in the control unit 22 despite a very high value of internal resistance of the cell 31 and, therefore, immediately begins to exhibit periodic fluctuations across the reference voltage at a relatively low frequency (such as several hertz) in response to fluctuations in the air/fuel ratio being realized in the engine 10. Accordingly, the feedback control of the air/fuel ratio can be commenced practically simultaneously with starting of the engine. The cell 31 is gradually heated by the exhaust gas and the heater 34, and at time point $T_3$, that is, after the lapse of a few minutes from the time point $T_1$, the temperature of the cell 31 reaches the level implied by the constant voltage $V_c$. Then the command signal $S_c$ disappears with the result that the switch 60 resumes the on-state to cause the intensity of the current flowing through the cell 31 to increase stepwise to the predetermined value optimum to the function of the sufficiently heated cell 31, so that the level of the sensor output does not undesirably lower when the internal resistance of the cell 31 lowered sufficiently.

Thus, the system according to the invention makes it possible to commence effective and stable feedback control of air/fuel ratio simultaneously with starting of the engine and, therefore, makes it possible to achieve a satisfactory level of exhaust emission control and improve the fuel economy even during a cold-starting phase of the engine operation. Besides, a stable feedback control by this system can be continued even during idling of the engine.

The oxygen-sensitive element 30 of FIG. 2 can be used also for detection of a non-stoichiometric air/fuel ratio, which may be either higher or lower than the stoichiometric ratio, by adequately determining the intensity of the DC current to be forced to flow in the solid electrolyte layer and the reference voltage to be compared with the output of this element. In the above described embodiment the aim of feedback control was a stoichiometric ratio, but the invention is applicable also to analogous air/fuel ratio control systems designed to maintain a predetermined non-stoichiometric air/fuel ratio by using an oxygen-sensitive element of the type as shown in FIG. 2.

The oxygen-sensitive element 30 of FIG. 2 can be operated also by forcing a constant DC current to flow in the solid electrolyte layer from the measurement electrode 40 toward the reference electrode 36. The concept of the present invention is useful also when the current is forced to flow in this direction.

The foregoing description of a preferred embodiment of the invention has been presented for the purpose of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A system for feedback control of the air/fuel mixture ratio for an internal combustion engine, the control system comprising:

an electrically controllable fuel supply means provided in the intake system of the engine;

an air/fuel ratio detector disposed in an exhaust passage of the engine and having an oxygen-sensitive element of a concentration cell type comprising a substrate, a microscopically porous reference electrode layer formed on the substrate, a microscopically porous layer of an oxygen ion conductive solid electrolyte formed on the substrate so as to cover the reference electrode layer substantially entirely and a microscopically porous measurement electrode layer formed on the solid electrolyte layer and an electric heater;

control means for providing a control signal to the fuel supply means to control the rate of fuel feed to the engine to maintain a predetermined air/fuel ratio by utilizing an output voltage of the air/fuel ratio detector as a feedback signal; and a sub-system for supplying a heating current to the heater of the air/fuel ratio detector and for causing a DC current of a predetermined intensity to flow through the solid electrolyte layer of the oxygen-sensitive element from the reference electrode layer toward the measurement electrode layer resulting in a migration of oxygen ions through the solid electrolyte layer from the measurement electrode layer toward the reference electrode layer to thereby establish a reference oxygen partial pressure at the interface between the reference electrode layer and the solid electrolyte layer, said sub-system further comprising temperature detection means for detecting the temperature of the oxygen-sensitive element as an indication of the internal resistance between the reference and measurement electrode layers of the oxygen-sensitive element and for providing a command signal while the detected temperature is below a predetermined temperature and current regulation means for decreasing the intensity of the DC current flowing through the solid electrolyte layer from said predetermined intensity by a definite value while the temperature detection means provides the command signal, whereby the basic level of the output voltage of the oxygen-sensitive element is precluded from undesirably rising while said internal resistance is excessively high.

2. A feedback control system according to claim 1, wherein said current regulation means comprises at least one resistance connected in series with the solid electrolyte layer of the oxygen-sensitive element to determine said predetermined intensity of the current caused to flow through the solid electrolyte layer, an additional resistance connected in series with said at least one resistance and an electrically controllable switch means connected in parallel with said additional resistance for normally short-circuiting said additional resistance and making said additional resistance effective while the temperature detection means provides said command signal.

3. A feedback control system according to claim 2, wherein said temperature detection means comprises a comparator which receives a variable voltage signal produced by the flow of said heating current in said heater as an indication of the temperature of the oxygen-sensitive element and a predetermined constant voltage signal indicative of said predetermined temperature as imputs for comparison and provides said command signal while the temperature indicated by said variable voltage signal is below the temperature indicated by said constant voltage signal.

4. A feedback control system according to claim 1, wherein said heater is embedded in said substrate of the oxygen-sensitive element.

5. A feedback control system according to claim 1, wherein said predetermined air/fuel ratio is a stoichiometric air/fuel ratio.

* * * * *